US011378903B2

(12) United States Patent
Kim et al.

(10) Patent No.: US 11,378,903 B2
(45) Date of Patent: Jul. 5, 2022

(54) IMAGE FORMING APPARATUS HAVING LONG-LIFE FIXING DEVICE

(71) Applicant: HEWLETT-PACKARD DEVELOPMENT COMPANY, L.P., Spring, TX (US)

(72) Inventors: Dong Kyun Kim, Suwon-Si (KR); Bong Hee Lee, Suwon-si (KR); Seong Yul Kim, Suwon-si (KR); Se Min An, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/963,953

(22) PCT Filed: Sep. 20, 2018

(86) PCT No.: PCT/KR2018/011117
§ 371 (c)(1),
(2) Date: Jul. 22, 2020

(87) PCT Pub. No.: WO2019/146870
PCT Pub. Date: Aug. 1, 2019

(65) Prior Publication Data

US 2021/0041819 A1 Feb. 11, 2021

(30) Foreign Application Priority Data

Jan. 23, 2018 (KR) ..... 10-2018-0008229

(51) Int. Cl.
*G03G 15/20* (2006.01)

(52) U.S. Cl.
CPC ..... *G03G 15/2053* (2013.01); *G03G 15/20* (2013.01); *G03G 15/2064* (2013.01); *G03G 2215/2032* (2013.01)

(58) Field of Classification Search
CPC ..... G03G 15/20; G03G 15/2032; G03G 15/2053; G03G 15/2064
See application file for complete search history.

(56) References Cited

U.S. PATENT DOCUMENTS

2005/0185994 A1 8/2005 Inada et al.
2008/0292374 A1 11/2008 Hiraoka et al.
(Continued)

FOREIGN PATENT DOCUMENTS

CN 105900021 8/2016
EP 3093715 11/2016
(Continued)

*Primary Examiner* — Gregory H Curran
(74) *Attorney, Agent, or Firm* — Staas & Halsey LLP

(57) ABSTRACT

A fixing device includes a pressing roller, a fixing belt disposed to be rotated by the pressing roller around a rotation axis of the fixing belt, a pressing member disposed within the fixing belt and to press a portion of the fixing belt toward the pressing roller, a pair of rotation ring members to support corresponding ends of the fixing belt respectively and being rotated by the fixing belt, and a pair of flange members to rotatably support the pair of the rotation ring members respectively, in which a rotation ring member of the pair of rotation ring members is an inclined state towards the fixing belt on a corresponding flange member, in which, with respect to the rotational axis of the fixing belt, an area of the rotation ring member opposite to a contacting area of the rotation member contacting with the pressed portion of the fixing belt protrudes more toward the fixing belt than the contacting area.

13 Claims, 10 Drawing Sheets

(56) References Cited

U.S. PATENT DOCUMENTS

| | | | | |
|---|---|---|---|---|
| 2011/0188907 | A1* | 8/2011 | Seki | G03G 15/20 399/329 |
| 2013/0177340 | A1* | 7/2013 | Kawata | G03G 15/2064 399/329 |
| 2013/0322937 | A1 | 12/2013 | Suzuki et al. | |
| 2016/0327893 | A1 | 11/2016 | Kim et al. | |

FOREIGN PATENT DOCUMENTS

| | | |
|---|---|---|
| JP | 2012141380 | 7/2012 |
| KR | 1019990077562 | 10/1999 |

* cited by examiner

【Figure 1】
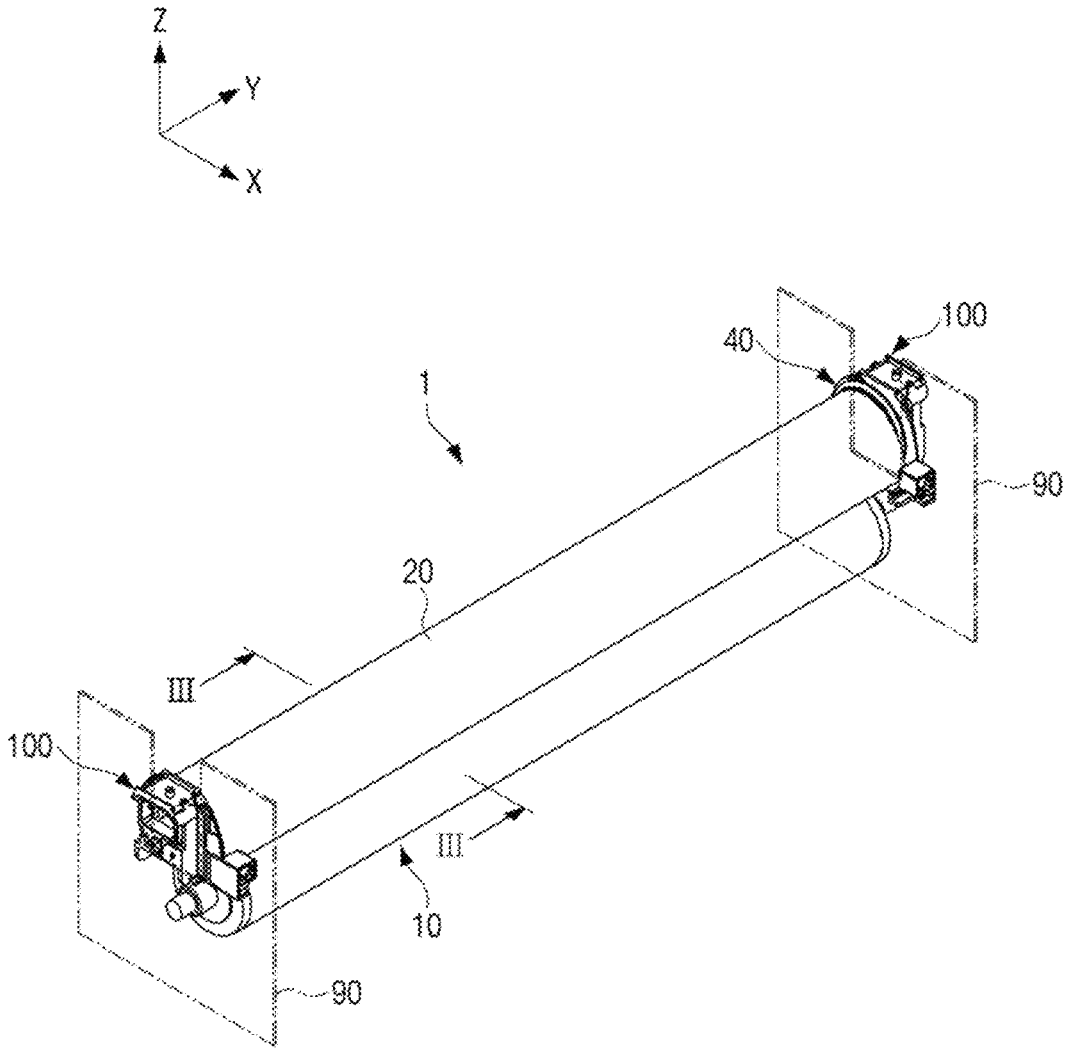

【Figure 2】
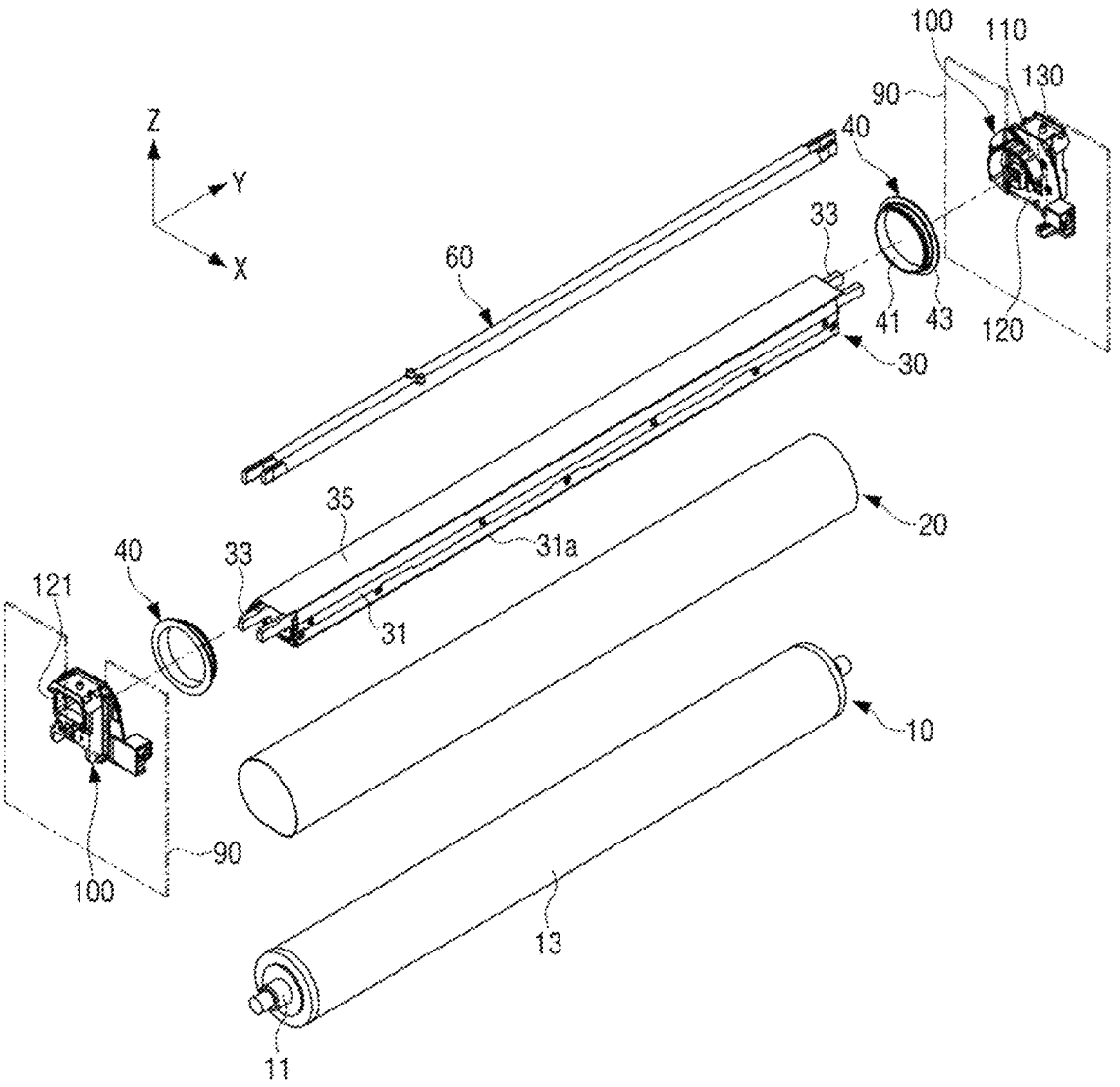

【Figure 3】
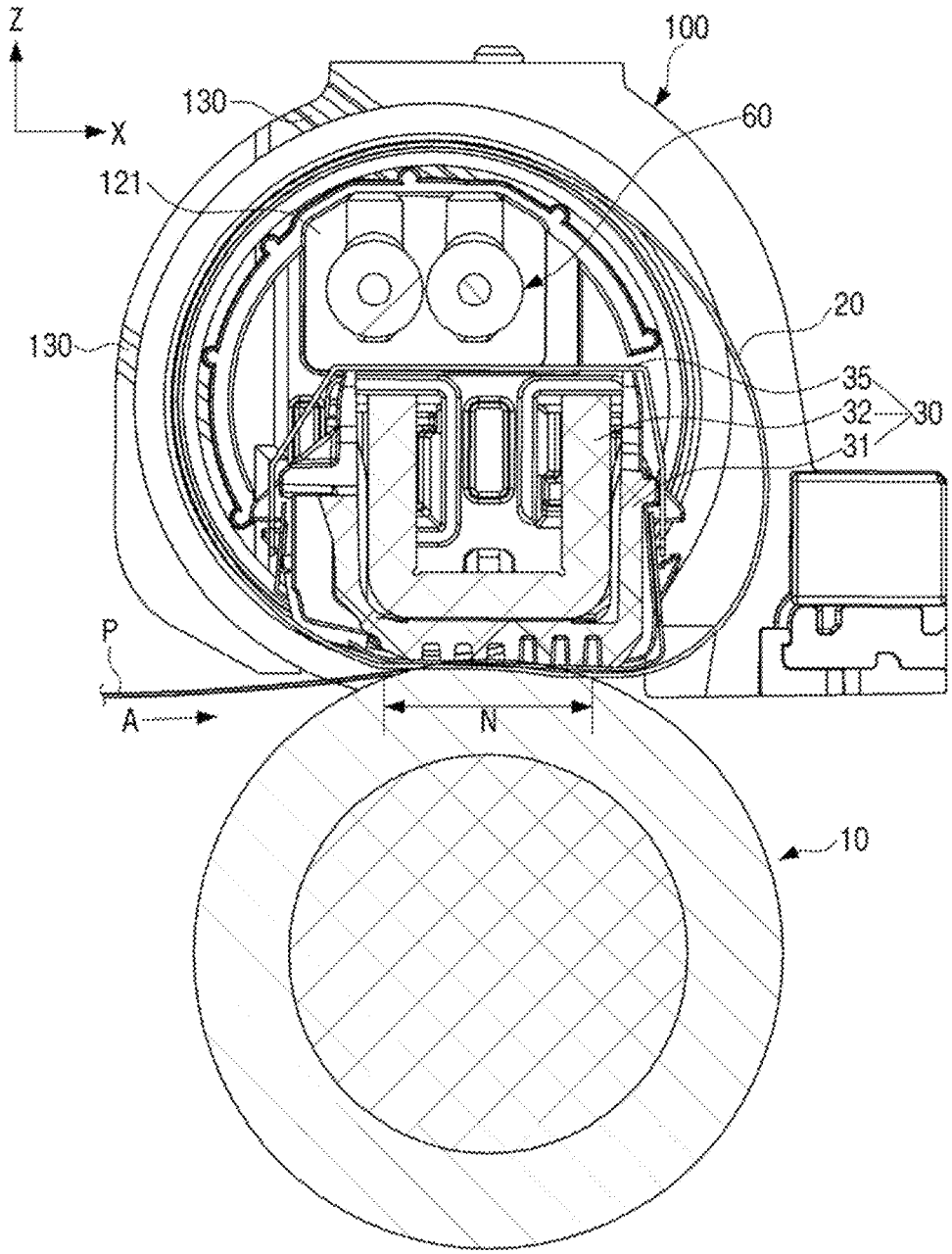

【Figure 4A】
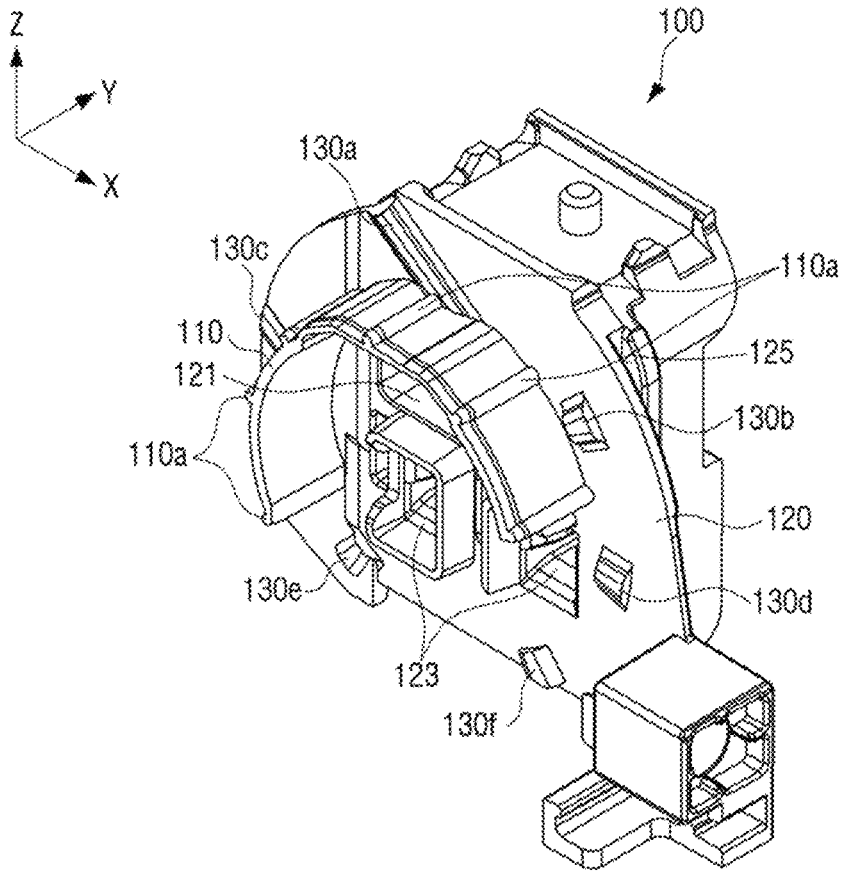

【Figure 4B】
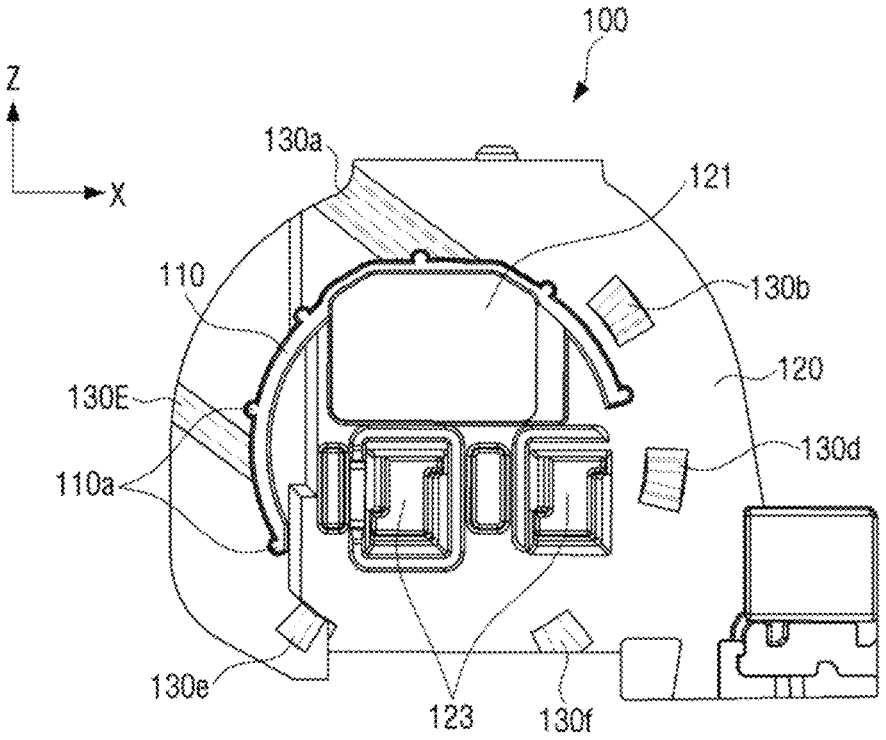
【Figure 5】
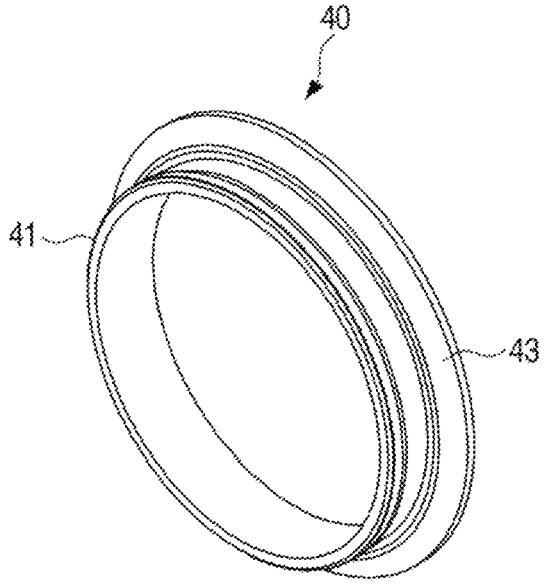

【Figure 6】
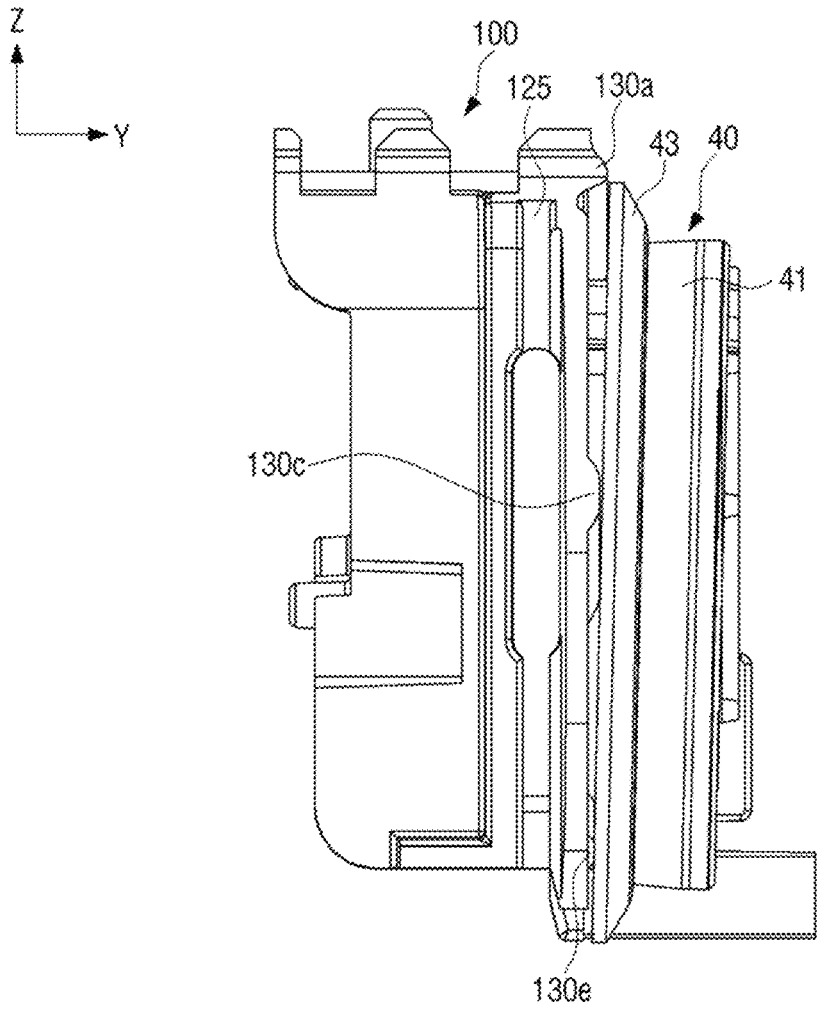

【Figure 7】
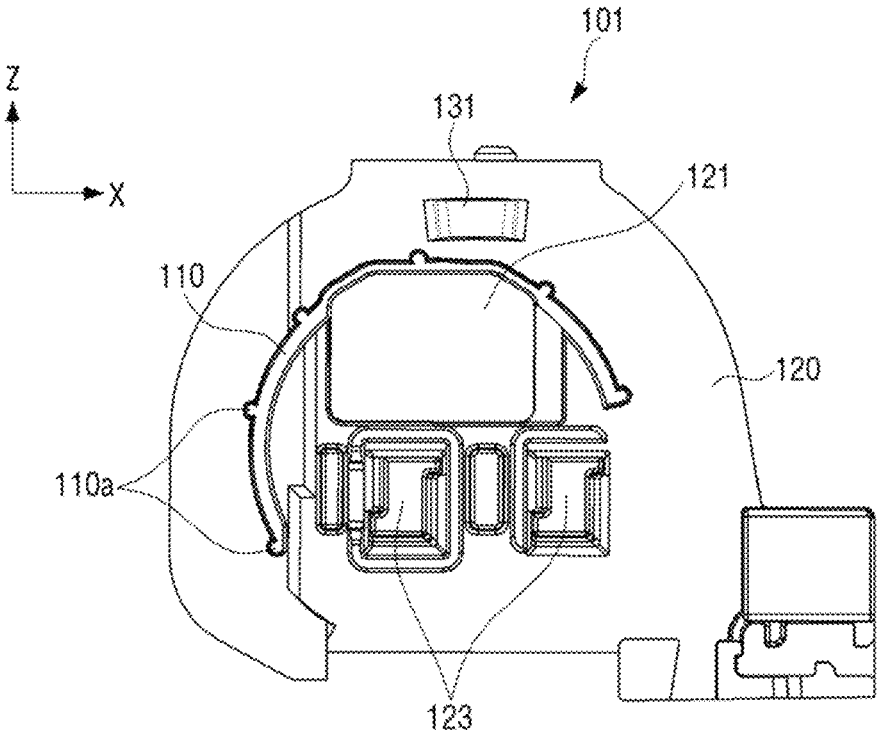

【Figure 8】
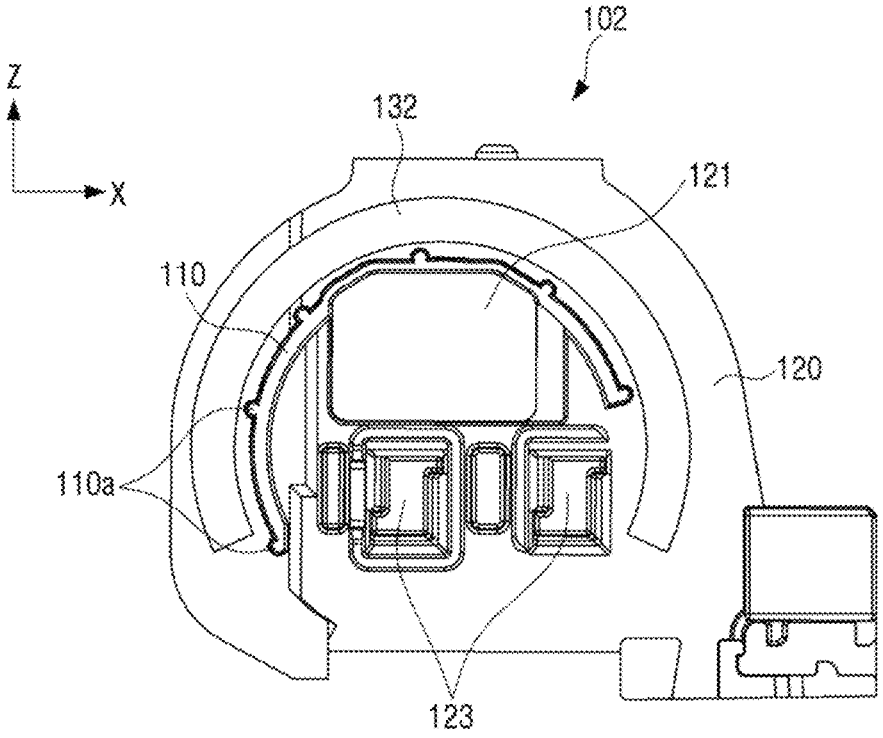

【Figure 9】
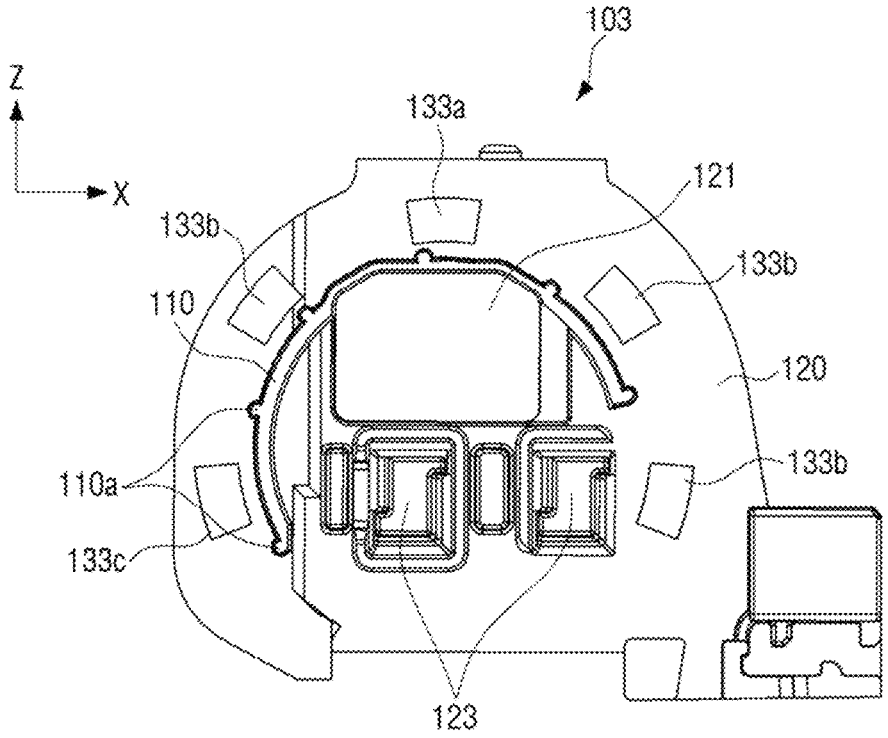

【Figure 10】
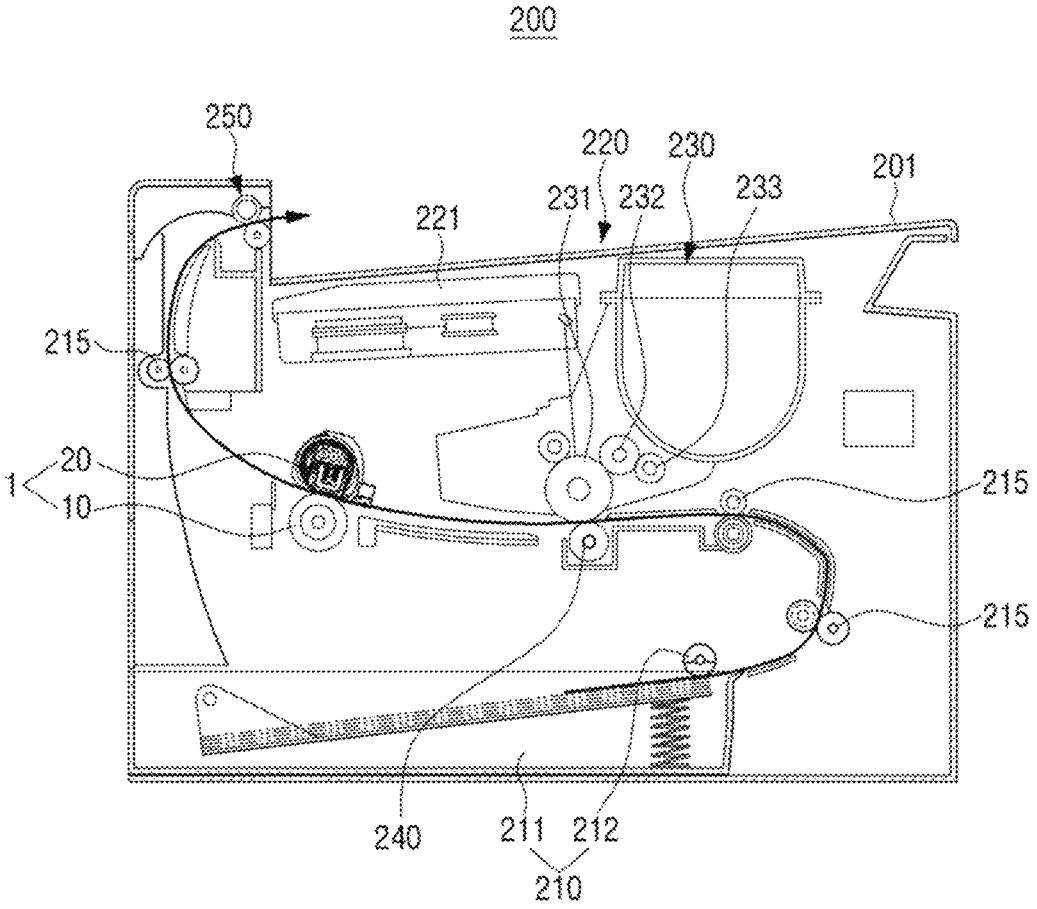

IMAGE FORMING APPARATUS HAVING LONG-LIFE FIXING DEVICE

CROSS REFERENCE TO RELATED APPLICATIONS

This application is filed under 35 U.S.C. 0.371 as a National Stage of PCT International Application No. PCT/KR2018/01117, filed on Sep. 20, 2018, in the Korean Intellectual Property Office, which claims the priority benefit of Korean Patent Application No. 10-2018-0008229, filed on Jan. 23, 2018, in the Korean Intellectual Property Office. The disclosures of PCT International Application No. PCT/KR2018/011117 and Korean Patent Application No. 10-2018-0008229 are incorporated by reference herein in their entireties.

BACKGROUND ART

Generally, an electrophotographic image forming apparatus such as a laser printer forms a developer image corresponding to a predetermined image onto a printing medium, and then permanently fixes the image onto the printing medium by applying heat and pressure to the developer image using a fixing device.

The fixing device includes a pair of rollers, that is, a fixing roller to generate heat to be applied to the printing medium and a pressing roller to apply a predetermined pressure to the printing medium.

DISCLOSURE

Description of Drawings

FIG. 1 is a perspective view of a fixing device according to an example;

FIG. 2 is a perspective view of the fixing device of FIG. 1 in disassembled state;

FIG. 3 is a cross-sectional view taken on line III-III of FIG. 1;

FIG. 4A is a perspective view of a flange member according to an example;

FIG. 4B is a front view of a flange member according to an example;

FIG. 5 is a perspective view of a rotation ring member according to an example;

FIG. 6 is a side view of a flange member provided with a rotation ring member according to an example;

FIG. 7 is a front view of a flange member according to another example;

FIG. 8 is a front view of a flange member according to another example;

FIG. 9 is a front view of a flange member according to another example; and

FIG. 10 is a brief cross-sectional view illustrating an image forming apparatus including a fixing device according to an example.

MODE FOR INVENTION

Meanwhile, many fixing devices provided for a high-speed, low-energy image forming apparatus recently use a fixing belt instead of the fixing roller, which is an endless belt having relatively small heat capacity. Such fixing belt is not provided with a rotation axis and instead rotated with pressing contact and driving of the pressing roller.

However, the fixing device using the fixing belt has shorter service life, as fatigue crack is generated on both ends of the fixing belt due to repetitive rotation of the fixing belt.

Accordingly, a fixing device is necessary, which has an extended service life by suppressing fatigue cracks of the both ends on the fixing belt.

Examples of the disclosure will now be described in greater detail with reference to the accompanying drawings. Examples described herein may be modified into various different forms and used. In order to more clearly describe the features of the examples, detailed description of the matters known to those skilled in the art pertinent to the examples will be omitted.

Throughout the description, when a portion is stated as being "connected" to another portion, it intends to include an example where the portions are "directly connected", and also an example where the portions are "electrically connected" while having another element therebetween. Further, throughout the description, when a portion is stated as "comprising (including)" an element, unless specified to the contrary, it intends to mean that the portion may additionally include another element, rather than excluding the same.

Further, the term "image forming apparatus" used herein refers to a device that prints printing data generated at a terminal such as a computer onto a recording medium. Examples of such image forming apparatus may include a copy machine, a printer, a fax machine or a multi-function printer (MFP) implementing a combination of the functions of the above into one device. Further, the image forming apparatus may refer to any device that is capable of performing an image forming job, including printer, scanner, fax machine, multi-function printer (MFP) or display, for example.

Further, the elements with the same functions within the same scope of the present disclosure appearing in the drawings of the respective examples will be referred to by the same reference numerals.

FIG. 1 is a perspective view of a fixing device according to an example, and FIG. 2 is a perspective view of the fixing device of FIG. 1 in disassembled state. FIG. 3 is a cross-sectional view taken on line III-III of FIG. 1.

Referring to FIGS. 1 to 3, the fixing device 1 according to an example includes a pressing roller 10, a fixing belt 20, a pressing member 30, a pair of rotation ring members 40, a pair of flange members 100 and a heat source 60.

The pressing roller 10 is configured to exert a predetermined pressure to a printing medium P and may have a roller shape. The pressing roller 10 may include a shaft 11 formed from a metal material such as aluminum or steel, and an elastic layer 13 that is elastically deformed to form a fixing nip N between the fixing belt 20 and itself. The elastic layer 13 may be formed from a silicon rubber. Although not illustrated in FIGS. 1 to 3, the pressing roller 10 may be configured to be rotated with a power received from a driving source such as a motor. The configuration of the pressing roller being rotated with the driving source will not be specifically explained herein, as it is same as, or similar to the driving configuration of the related pressing roller.

The fixing belt 20 may apply a predetermined heat to the printing medium P; and likewise the related heating roller, may be heated by the heat source 60 and deliver the heat to the printing medium P passing through the fixing nip N. Accordingly, the fixing belt 20 may be configured to face the pressing roller 10 and form a fixing nip N in cooperation with the pressing roller 10, through which the printing medium P passes. The fixing belt 20 may be configured to be rotated by the pressing roller 10. When the pressing roller 10 is rotated, the fixing belt 20 may be rotated by friction force between the fixing belt 20 and the pressing roller 10. A length of the fixing belt 20 in an axis direction may be greater than a length of the pressing roller 10 in an axis direction. The fixing belt 20 may be configured as a single layer of metal, heat-resistant polymer, or the like, or, may be configured by adding an elastic layer and a protecting layer to a basic layer formed from metal or heat-resistant polymer. The fixing belt 20 that is same as, or similar to the fixing belt used in the related belt-type fixing device may be used, and the fixing belt 20 will not be redundantly explained herein.

The pressing member 30 may be provided on an inner side of the fixing belt 20, and may support an inner surface of the fixing belt 20 as the fixing belt 20 forms the fixing nip N by a contact with the pressing roller 10. The pressing member 30 may have a greater length than that of the pressing roller 10. Accordingly, when the fixing nip N is formed by the pressing roller 10 contacting the fixing belt 20, bending on both ends of the fixing belt 20 due to the pressing roller 10 is not occurred. Specifically, the pressing member 30 may include a guide member 31 that guides the fixing belt 20 in contact with the inner surface of the fixing belt 20, and a support member 32 disposed above the guide member 31 to press and support the guide member 31.

The guide member 31 is brought into contact with an inner surface of the fixing belt 20 and forms a fixing nip N, and guides the fixing belt 20 to run smoothly near the fixing nip N. The guide member 31 may be formed as a U-shaped channel in cross-section, which has a roughly flat bottom, with the support member 32 being provided on an inner side thereof. A heat disconnect member 35 may be coupled with both sides of the guide member 31.

The support member 32 may reinforce the guide member 31 to minimize the bending distortion of the guide member 31. The support member 32 may be formed as a channel having a U-shaped cross-section, which has a roughly flat bottom, and provided on an inner side of the guide member 31. Not only the U-shape having a flat bottom, the support member 32 may also be configured as other structure with a high area moment of inertia, such as I-shaped beam, H-shaped beam, or the like.

The heat disconnect member 35 may prevent the heat generated from the heat source 60 from directly being radiated to the guide member 31. For the above, the heat disconnect member 35 may be provided above the guide member 31 and the support member 32 to cover the guide member 31 and the support member 32. Specifically, the heat disconnect member 35 may be provided under the heat source 60 and above the support member 32 inserted into the guide member 31.

As illustrated in FIG. 3, when a lower surface of the pressing member 30, i.e., when the lower surface 31*a* of the guide member 31 is in contact with the inner surface of the fixing belt 20, the fixing nip N is formed between the portion of the fixing belt 20 supported by the lower surface 31*a* of the guide member 31 and an upper portion of the pressing roller 10 which is in contact therewith. Accordingly, when the pressing roller 10 is rotated, the fixing belt 20 is rotated by friction with the pressing roller 10.

A pair of rotation ring members 40 may be provided on both ends of the fixing belt 20, supporting both ends of the fixing belt 20 and controlling a movement of the fixing belt 20 in the direction of a center axis thereof. A pair of rotation ring members 40 may be provided to minimize generation of fatigue crack on both ends of the fixing belt 20 when the fixing belt 20 is rotated by the pressing roller 10.

A pair of flange members 100 may rotatably support a pair of rotation ring members 40. Accordingly, when the fixing belt 20 is rotated by friction force with the pressing roller 10, the fixing belt 20 may be rotated via a pair of rotation ring members provided between the fixing belt 20 and the flange member 100 rather than being rotated in direct frictional contact with the flange member 100.

Regarding a position of the fixing nip N to form an image, the fixing belt 20 may be in a linear movement along a printing medium transfer direction A, and the rotation ring members 40 in a rotating movement and supporting inner surfaces of both ends of the fixing belt 20 may be in a circular movement.

When thrust force is generated by the axial meandering force during the rotation of the fixing belt 20, the rotation ring members 40 that support both ends of the fixing belt 20 repeat pulling up the fixing belt 20, which are linearly moving in the printing medium transfer direction A, along the rotation direction of the rotation ring members 40 and then dropping the fixing belt 20. In this example, the fixing belt 20 may be bent or may flutter. Such bending or fluttering of the fixing belt 20 may occur at a portion where the fixing nip N is formed, and the fixing belt 20 may have fatigue crack generated on an end of the fixing belt 20 due to the bending or fluttering phenomenon at the portion where the fixing nip N is formed.

While supporting the inner surface of the fixing belt 20 and rotating, an ideal expectation is that the rotation ring members 40 are rotated at the same velocity as that of the fixing belt 20. However, when the phenomenon described above occurs, that is, when the rotation ring members 40 rotating at the fixing nip N pull up the fixing belt 20, which are linearly moving in the printing medium transfer direction A, along the rotation direction of the rotation ring members 40 and then drop the fixing belt 20, the rotation velocity of the rotation ring members 40 is delayed from that of the fixing belt 20. When this difference in rotation velocity occurs between the rotation ring members 40 and the fixing belt 20, slip occurs at a position where the rotation ring members 40 are in contact with the fixing belt 20 and both ends of the fixing belt 20 are worn out due to friction with the rotation ring members 40.

In order to minimize fatigue crack on both ends of the fixing belt 20, the rotation ring members 40 may be inclined on the flange member 100 in which case the area opposite the fixing nip N area of the fixing belt 20 is relatively protruded than the fixing nip N area. Accordingly, the rotation ring members 40 may minimize friction with the ends of the fixing belt 20 as they are not brought into contact with an area where the linear movement of the fixing belt 20 meets the circular movement of the rotation ring members 40. Constitution of the flange member 100 and the rotation ring members 40 will be further explained below.

The heat source 60 may be provided within the fixing belt 20, and generates a heat to heat the fixing belt 20 up to a fixing temperature. The heat source 60 may be provided above the pressing member 30 between a pair of flange members 100. The heat source 60 may be inserted into the fixing belt 20 through a through hole 121 provided in the flange member 100. For the heat source 60, a halogen lamp, a ceramic heater or the like may be used. An electric wire for supplying electric power may be connected to the heat source 60. However, in FIG. 2, the electric wire is omitted for convenience of illustration. Because a heat source used in the related fixing device may be used also for the heat source 60, it will not be further explained below.

Although the constitution in which the heat source 60 is provided above the pressing member 30 to heat the fixing belt 20 by radiation, other examples are possible. For example, the heat source 60 may be configured to directly heat the fixing belt 20. In other words, a ceramic heater may be provided as the heat source 60 on a lower surface 31*a* of the guide member 31 near the fixing nip N, in which case the ceramic heater may directly heat the inner surface of the fixing belt 20. For another example of the heat source 60, a surface heating element (not illustrated) may be used. The surface heating element is an electric resistance material that generates heat upon supply of electric currents, and may be a layer sandwiched between an outer surface and an inner surface of the fixing belt 20.

FIGS. 4A and 4B are perspective diagram and front diagram of a flange member according to an example.

Referring to FIGS. 4A and 4B, the flange member 100 may include a stationary body 120, a rotation ring support 110 and a protrusion 130.

The stationary body 120 may be fastened to a frame of the fixing device or to an inner frame of a main body 201 of the image forming apparatus. The stationary body 120 may be formed in a roughly rectangular shape, and have the rotation ring support 110 provided on a front side, and a fastening groove 125 provided on both sides to receive the frame 90 therein (FIGS. 1 and 2). According to an example, the stationary body 120 is fixed to the frame 90 by the fastening groove 125 by way of example. However, a method for fastening the stationary body 120 to the frame 90 is not limited hereto. The stationary body 120 may be fastened to the frame 90 with various methods including screw fastening.

The rotation ring support 110 may be eccentrically formed from a center of the stationary body 120. A through hole 121 for receiving the heat source 60 may be formed under the rotation ring support 110. Two fastening grooves 123 to fixedly receive the pressing member 30 may be provided under the through hole 121. Both ends of the pressing member 30, or more specifically, both ends of the guide member 31 may be provided with two fastening bars 33 which are inserted into the two fastening grooves 123 of the flange member 100.

The rotation ring support 110 may be extended perpendicularly from a front side of the stationary body 120 and rotatably support the rotation ring member 40. The rotation ring support 110 may be formed in various shapes that can support load of the rotation ring member 40 during rotation of the fixing belt 20 while supporting the rotation of the rotation ring member 40. FIG. 4A illustrates the rotation ring support 110 formed in a circular arc shape to provide a space thereunder. Accordingly, a space for installation of the heat source 60 may be provided under the rotation ring support 110. In this example, the rotation ring support 110 may be formed in a circular arc shape which is larger or smaller than a semicircle. According to an example, the rotation ring support 110 may be in a roughly semicircular shape. However, the present disclosure is not limited to a specific example, and accordingly, the rotation ring support 110 may be formed in various shapes.

A plurality of ribs 110*a* may be configured to minimize friction between an inner support 41 of the rotation ring member 40 and the rotation ring support 110 of the flange member 100. A plurality of ribs 110*a* may reduce friction between the rotation ring member 40 and the flange member 100, because an inner surface of the inner support 41 of the rotation ring member 40 are not entirely in contact with an outer surface of the rotation ring support 110.

Specifically, a plurality of ribs 110*a* may be configured to prevent the inner support 41 of the rotation ring member 40 from a plane-contact with an outer surface of the rotation ring support 110, in which case the outer surface of the rotation ring support 110 may support the inner surface of the inner support 41 of the rotation ring member 40 by line-, or point-contact.

Further, the flange member 100 may be provided with a protrusion 130 to improve service life of the fixing belt 20 during rotation of the rotation ring member 40.

The protrusion 130 may be configured to reduce friction generated between the fixing belt 20 and the rotation ring member 40 where bending or fluttering phenomenon occurs during rotation of the rotation ring member 40. The protrusion 130 may support the rotation ring member 40 to be inclined in a contact area where the fixing nip N is formed between the fixing belt 20 and the pressing roller 10, in which case the rotation ring member 40 is not brought into contact with the fixing belt 20.

A plurality of protrusions 130 may be configured to allow the rotation ring member 40 to be disposed on the flange member 100 while a lower end thereof are inclined toward the direction of flange member 100. Specifically, a plurality of protrusions 130 may be formed on the stationary body 120 of the flange member 100 to support the rotation ring member 40 by line- or point-contact. In this example, a plurality of protrusions 130 may be formed on a surface of the stationary body 120 of the flange member 100 to stably support the rotation ring member 40. As illustrated in FIG. 4B, six protrusions 130*a*, 130*b*, 130*c*, 130*d*, 130*e*, 130*f* may be provided on the stationary body 120 of the flange member 100.

The protrusions 130*a*, 130*b*, 130*c*, 130*d*, 130*e*, 130*f* may be formed in a spherical shape or in a column shape having a semicircular or circular cross-section. A plurality of protrusions 130*a*, 130*b*, 130*c*, 130*d*, 130*e*, 130*f* may be in point-contact with the rotation ring member 40. In this example, the protrusions 130*a*, 130*b*, 130*c*, 130*d*, 130*e*, 130*f* may not be disposed in the fixing nip N area, but disposed in the remainder area, to support the rotation ring member 40 in an inclined state.

A portion where the protrusions 130 are not formed may correspond to an area where the fixing belt 20 is brought into contact with the pressing roller 10, and more specifically, it indicates a lower end of the flange member 100.

A plurality of protrusions 130*a*, 130*b*, 130*c*, 130*d*, 130*e*, 130*f* may protrude to an higher height as they are distanced farther away from the lower end of the flange member 100. In the order of remote distance from the lower end of the flange member 100, there may be a first protrusion 130*a*, a second protrusion 130*b*, a third protrusion 130*c*, a fourth protrusion 130*d*, a fifth protrusion 130*e* and a sixth protrusion 130*f*. The first protrusion 130*a* formed on an upper end opposite the lower end of the flange member 100 may be protruded to the greatest height. The height of the sixth protrusion 130*f* may be lowest. The second protrusion 130*b*, the third protrusion 130*c*, the fourth protrusion 130*d*, the fifth protrusion 130*e*, and the sixth protrusion 130*f* which become nearer to the lower end of the flange member 100 from the first protrusion 130*a* may have sequentially decreasing heights.

Meanwhile, the protrusions disposed on positions laterally symmetrical to each other may have the same height in order to prevent the rotation ring member 40 from being tilted laterally. Specifically, the second protrusion 130*b*, the third protrusion 130*c*, and the fourth protrusion 130*d* may have heights to support the rotation ring member 40 from being tilted laterally.

The protrusions 130*a*, 130*b*, 130*c*, 130*d*, 130*e*, 130*f* may be laterally symmetrical to each other to stably support the rotation ring member 40. The first to sixth protrusions 130*a*, 130*b*, 130*c*, 130*d*, 130*e*, 130*f* may be in different shapes from each other, but not limited hereto. The first to sixth protrusions 130*a*, 130*b*, 130*c*, 130*d*, 130*e*, 130*f* may be formed in the same shape or formed in a lateral symmetry with each other.

Leading ends of the protrusions 130*a*, 130*b*, 130*c*, 130*d*, 130*e*, 130*f* may be processed into a convex form for a stable contact with a side support 43 of the rotation ring member 40. Although FIGS. 4A and 4B provide an example in which the protrusions are formed in a rounded shape, the shape of the protrusions 130 may not be limited hereto. The protrusions 130 may be formed in various shapes that can stably support the side support 43 of the rotation ring member 40. For example, the shape of the protrusions 130 may include cone, polypyramid, truncated cone, truncated polypyramid, or the like. In this case, the protrusions 130 may support the side support 43 of the rotation ring member 40 by point-contact.

FIG. 5 is a perspective view of a rotation ring member according to an example.

Referring to FIG. 5, the rotation ring member 40 may be extended and formed in a perpendicular direction to the inner support 41 that supports the inner surface of the fixing belt 20, and may include a side support 43 that prevents a movement of the fixing belt 20 in the direction of a center axis thereof.

The inner support 41 of the rotation ring member 40 may be formed in a ring shape, and the side support 43 may be extended in a perpendicular direction from one end of the inner support 41 to an outer side of the inner support 41 by a predetermined length.

An inner diameter of the inner support 41 of the rotation ring member 40 may be sized to be inserted into an outer side of the rotation ring support 110 of the flange member 100.

In order to reduce friction between the rotation ring member 40 and the rotation ring support 110 of the flange member 100, the rotation ring member 40 may be formed from a material having less friction.

A width W of the side support 43 extending from the inner support 41 of the rotation ring member 40 may be greater than a depth of the fixing belt 20, in which case the fixing belt 20 rotating with the rotation ring member 40 is prevented from riding over the side support 43.

The inner support 41 that supports an inner surface of the fixing belt 20 may be formed from a material having a greater friction than the side support 43 that supports an end of the fixing belt 20. The surface of the inner support 41 may be rough while the surface of the side support 43 may be smooth, which may improve the difference in velocity between the rotation ring member 40 and the fixing belt 20.

For the greater surface roughness of the inner support 41 than that of the side support 43, a groove extending in parallel to a rotation axis direction of the fixing belt 20 may be provided, which may be included in the inner support 41 to be more specific.

Further, a plurality of protrusions 130 may be configured to reduce friction generated between the side support 43 of the rotation ring member 40 and a side of the stationary body 120 of the flange member 100 during rotation of the rotation ring member 40. A plurality of protrusions 130 may be configured to prevent the side support 43 of the rotation ring member 40 from an entire plane-friction with the stationary body 120 of the flange member 100.

In this case, the protrusions 130 may support the rotation ring member 40, while being in line-contact with the side support 43 of the rotation ring member 40. Accordingly, a plurality of protrusions 130 may stably support the side support 43 of the rotation ring member 40, and minimize friction with the stationary body 120 of the flange member 100 during rotation of the rotation ring member 40.

According to an example, operation of the fixing device 1 will be explained below.

When the pressing roller 10 is rotated, the fixing belt 20 in contact with the pressing roller 10 may be rotated by friction force with the pressing roller 10. In this example, both ends of the fixing belt 20 may be supported by a pair of rotation ring members 40. Further, a pair of rotation ring members 40 may be in the state of being inserted in the rotation ring support 110 of a pair of the flange members 100. Accordingly, when the fixing belt 20 is subjected to the friction force from the rotating pressing roller 10, the fixing belt 20 may be rotated, while being supported by the rotation ring support 110 of a pair of flange members 100 and a pair of rotation ring members 40.

In this example, because the rotation ring members 40 according to an example are rotated in the inclined state with respect to the flange member 100, the circularly-moving rotation ring members 40 do not meet the linearly-moving fixing belt 20 at a lower end where the fixing nip N is formed. Accordingly, little friction force is exerted by the rotation ring members 40 onto the ends of the fixing belt 20.

Further, because the protrusions 130 are provided on the flange member 100 in the present disclosure, friction force between the rotation ring support 110 of the flange member 100 and the inner support 41 of the rotation ring members 40 is very little.

If the fixing belt 20 and the rotation ring members 40 do not rotate at same velocity and the fixing belt 20 performs relative movement with respect to the rotation ring members 40, the relative velocity of the fixing belt 20 to the rotation ring members 40 is considerably slower than the relative velocity of the rotation ring member 40 rotating with respect to the rotation ring support 110 of the flange member 100. Accordingly, fatigue crack generated from the rotation of the fixing belt 20 with respect to the flange member 100 may be reduced.

Printing service life has been tested in order to confirm life extension effect of the belt-type fixing device 1 according to an example. As a result, the fixing device 1 according to an example, when used, exhibited an effect of four times longer life extension than the related fixing device. Further, when the fixing device 1 according to an example is used, crack is not generated on the fixing belt 20.

FIG. 6 is a side view of a flange member provided with a rotation ring member according to an example.

Referring to FIG. 6, when the rotation ring member 40 is inserted into the rotation ring support 110 of the flange member 100, the rotation ring member 40 may be rotated with respect to the rotation ring support 110. In this example, the rotation ring member 40 may be rotated with respect to a center of the rotation ring support 110 of the flange member 100 as a center of rotation.

The rotation ring member 40 may be inclined on the flange member 100 in which case the area opposite the contact area having the fixing nip N formed between the fixing belt 20 and the pressing roller 10 is relatively protruded than the contact area having the fixing nip N. In other words, the rotation ring member 40 may be inclined in which case it is further protruded on an upper end of the flange member 100 than on a lower end.

When the rotation ring member 40 is inserted into the rotation ring support 110 of the flange member 100, the rotation ring member 40 may be rotated in the inclined state with respect to the flange member 100 by rotation of the fixing belt 20. In this example, the circularly-moving rotation ring member 40 may not meet the linearly-moving fixing belt 20 at a lower end where the fixing nip N is formed. As the rotation ring member 40 is inclined and is thus less protruded on a portion where the fixing nip N is formed than the remainder portion, the force of the rotation ring member 40 may not be applied to the ends of the fixing belt 20. Accordingly, the fixing belt 20 may be rotated without bending or fluttering.

The rotation ring member 40 may be supported in the inclined state by the protrusions 130*a*, 130*b*, 130*c*, 130*d*, 130*e*, 130*f* protruded from the stationary body 120 of the flange member 100. The first protrusion 130*a* may be most protruded on an upper end of the flange member 100. The third protrusion 130*c* and the fifth protrusion 130*e*, which are positioned nearer to the portion formed with the fixing nip N than the first protrusion 130*a*, may be less protruded than the first protrusion 130*a* in that order.

Accordingly, when the rotation ring member 40 is inserted into the rotation ring support 110 of the flange member 100, the rotation ring member 40 may be inclined by the presence of a plurality of protrusions 130*a*, 130*b*, 130*c*, 130*d*, 130*e*, 130*f*, in which case an upper end may be relatively protruded than a lower end formed with the fixing nip N.

When the fixing belt 20 is rotated, the fixing belt 20 may perform a linear movement in a printing medium transfer direction A at a portion where the fixing nip N is formed, and the rotation ring member 40 that is rotated while supporting an inner surface of both ends of the fixing belt 20 may perform a circular movement.

In this example, as the rotation ring member 40 is inclined and the flange member 100 is further protruded at the upper end thereof than at the lower end, the rotation ring member 40 that is rotated while supporting both ends of the fixing belt 20 may not be brought into contact with the fixing belt 20 that is linearly moved in a printing medium transfer direction A, at the fixing nip N portion. In other words, the rotation ring members 40 are not brought into contact with a portion where the linear movement of the fixing belt 20 meets the circular movement of the rotation ring member 40. Accordingly, the ends of the fixing belt 20 are not subjected to force. As a result, bending phenomenon and fluttering phenomenon of the fixing belt 20 may be reduced and difference in rotation velocity between the rotation ring member 40 and the fixing belt 20 during rotation may be decreased, and therefore, wearing phenomenon due to slip on the contact surface between the fixing belt 20 and the rotation ring member 40 may be decreased.

FIG. 7 is a front view of a flange member according to another example.

Referring to FIG. 7, the flange member 101 according to another example is similar to the flange member 100 described above. For example, the stationary body 120 and the rotation ring support 110 of the flange member 101 may be same as those of the flange member 100 described above. Accordingly, these elements will not be described repeatedly.

As illustrated in FIG. 7, one single protrusion 131 may be protruded on the flange member 101. The protrusion 131 may be disposed nearer to an upper end opposite a lower end of the flange member 101 where the fixing nip N is formed. The protrusion 131 may be protruded convexely in a direction of facing the rotation ring member 40.

The rotation ring member 40 may be inclined by the protrusion 131 formed on an upper end of the flange member 101, in which case the rotation ring member 40 is further protruded at the upper end thereof than at the lower end.

Further, the protrusion 131 may extend laterally, in which case the rotation ring member 40 may be prevented from being tilted laterally. A front end of the protrusion 131 may be extended laterally to be stably in line-contact with the side support 43 of the rotation ring member 40. In this case, the protrusion 131 may support the side support 43 of the rotation ring member 40 by line-contact.

FIG. 8 is a front view of a flange member according to another example.

Referring to FIG. 8, the flange member 102 according to another example is similar to the flange member 100 described above in terms of the fact that it 102 also includes the stationary body 120 and the rotation ring support 110.

As illustrated in FIG. 8, the flange member 100 may include a friction reduction member 132 instead of the protrusions 130 protruding thereon. The friction reduction member 132 may be configured as a separate member between the rotation ring member 40 and the flange member 102. The friction reduction member 132 may be formed from plastic mold or film, sponge, or fabric which can reduce friction.

The friction reduction member 132 may be formed in a circular arc shape that encloses the rotation ring support 110. The friction reduction member 132 may be formed on a portion corresponding to a portion formed with the fixing nip N, except the lower end of the flange member 100.

The rotation ring member 40 may be inclined by the friction reduction member 132, in which case the rotation ring member 40 may be further protruded at the upper end than at the lower end.

FIG. 9 is a front view of a flange member according to another example.

Referring to FIG. 9, a plurality of friction reduction members 133*a*, 133*b*, 133*c*, 133*d*, 133*e*, 133*f* may be provided on a surface of the stationary body 120 of the flange member 100 to stably support the rotation ring member 40. As illustrated in FIG. 9, six friction reduction members 133*a*, 133*b*, 133*c*, 133*d*, 133*e*, 133*f* may be provided on the stationary body 120 of the flange member 103.

A plurality of friction reduction members 133*a*, 133*b*, 133*c*, 133*d*, 133*e*, 133*f* may be in contact with the rotation ring member 40. In this example, the friction reduction members 133*a*, 133*b*, 133*c*, 133*d*, 133*e*, 133*f* may not be disposed in the fixing nip N area, but disposed in the remainder area, to support the rotation ring member 40 in an inclined state.

The portion where the friction reduction members 133*a*, 133*b*, 133*c*, 133*d*, 133*e*, 133*f* are not formed, may correspond to an area where the fixing belt 20 and the pressing roller 10 are in contact with each other, and specifically, to the lower end of the flange member 103.

FIG. 10 is a brief cross-sectional view illustrating an image forming apparatus including a fixing device according to an example.

Hereinbelow, referring to FIG. 10, the image forming apparatus 200 including a belt-type fixing device 1 according to an example will be explained.

Referring to FIG. 10, the image forming apparatus 200 includes a main body 201, a printing medium feed device 210, an image forming device 220, a belt-type fixing device 1, and a discharge device 250.

The main body 201 may form an appearance of the image forming apparatus 200, and contain and support therein the printing medium feed device 210, the image forming device 220, the belt-type fixing device 1, and the discharge device 250.

The printing medium feed device 210 may be provided within the main body 201 and may supply the printing medium P to the image forming device 220, and may include a feeding cassette 211 and a pickup roller 212. A feeding cassette 211 may load a predetermined number of printing mediums and a pickup roller 212 may pick up the loaded the printing mediums from the feeding cassette 211 one by one to supply the same to the image forming device 220.

A plurality of transfer rollers 215 to move the printing medium P picked up from the pickup roller 212 may be provided between the pickup roller 212 and the image forming device 220.

The image forming device 220 is configured to form a predetermined image onto the printing mediums P supplied from the printing medium feed device 210 and may include an exposure device 221, a developing cartridge 230, and a transfer roller 240. The exposure device 221 may emit a predetermined light corresponding to printing data according to a printing command. The developing cartridge 230 may be provided on one side of an image bearing member 231 on which electrostatic latent image is formed by the light generated from the exposure device 221, and may include a developing roller 232 for developing the electrostatic latent image formed on the image bearing member 231 into a developer image by supplying a developer to the image bearing member 231. Further, the developing cartridge 230 may store a predetermined developer, and include a developer supply roller 233 for supplying a developer to the developing roller 232, or the like. The transfer roller 240 may be rotated while facing the image bearing member 231 of the developing cartridge 230, and may transfer the developer image formed on the image bearing member 231 to the printing medium P.

The belt-type fixing device 1 may fix the developer image onto the printing medium P by applying heat and pressure, while the printing medium P transferred with the developer image is passed through the image forming device 220. Because constitution and operation of the belt-type fixing device 1 are described above, it will not be specifically explained below.

The discharge device 250 is configured to discharge the printing medium P formed with image out of the image forming apparatus 200 after the printing medium is passed through the belt-type fixing device 1, and may be formed with a pair of discharge rollers which are rotated while facing each other.

The belt-type fixing device 1 according to the example described above may fix a developer image transferred onto a printing medium P onto the printing medium P. Further, because both ends of the fixing belt 20 of the belt-type fixing device 1 according to an example may be supported by a pair of rotation ring members 40, fatigue crack on both ends of the fixing belt 20 generated from rotation of the fixing belt 20 directly contacted with the flange member 100 may be minimized.

As described above, the present disclosure may be applied to S path-type image forming apparatus, and also C path-type image forming apparatus.

While the present disclosure has been particularly shown and described with reference to examples thereof, it is to be understood that the present disclosure is not limited to the examples thereof, it will be understood that various modifications may be made by those skilled in the art without departing from the spirit and scope of the present disclosure.

The invention claimed is:

1. A fixing device, comprising:

a pressing roller;

a fixing belt disposed to be rotated by the pressing roller around a rotation axis of the fixing belt;

a pressing member disposed within the fixing belt to press a portion of the fixing belt toward the pressing roller;

a pair of rotation ring members to support corresponding ends of the fixing belt respectively and be rotated by the fixing belt; and a pair of flange members to rotatably support the pair of rotation ring members respectively;

wherein a corresponding flange member of the pair of flange members includes a protrusion, formed on a first contact portion, among contact portions, on a front side of the corresponding flange member, to come into contact with a rotation ring member of the pair of rotation ring members to support the rotation ring member in an inclined state towards the fixing belt in which, with respect to the rotational axis of the fixing belt, an area of the rotation ring member, which is opposite to a contacting area of the rotation ring member contacting the pressed portion of the fixing belt, comes into contact with the protrusion to cause the rotation ring member to protrude more towards the fixing belt at the area opposite to the pressed portion of the fixing belt than the contacting area of the rotation ring member.

2. The fixing device of claim 1, wherein the protrusion is formed around the area opposite to the pressed portion of the fixing belt.

3. The fixing device of claim 1, wherein the corresponding flange member of the pair of flange members comprises:

a stationary body; and a rotation ring support extending from the front side of the stationary body and to rotatably support the rotation ring member of the pair of rotation ring members, the protrusion is formed on a front side of the stationary body.

4. The fixing device of claim 3, wherein the protrusion includes a plurality of protrusions disposed along the rotation ring support.

5. The fixing device of claim 4, wherein the plurality of protrusions are disposed such that, among the plurality of protrusions, a protrusion disposed farther away from the pressed portion of the fixing belt has an increased height than another protrusion disposed closer to the pressed portion of the fixing belt, to cause the inclined state.

6. The fixing device of claim 4, wherein the plurality of protrusions are disposed along the rotation ring support in a remainder area except for a corresponding area that corresponds to the pressed portion of the fixing belt, to cause the inclined state.

7. The fixing device of claim 2, wherein the corresponding flange member of the pair of flange members comprises a friction reduction member disposed on a second contact portion among the contact portions in contact with the rotation ring member.

8. The fixing device of claim 7, wherein the friction reduction member is sponge or fabric.

9. The fixing device of claim 1, further comprising a heat source to heat the fixing belt.

10. The fixing device of claim 1, wherein the rotation ring member of the pair of rotation ring members comprises a first surface rotated possibly in contact with a corresponding end of the corresponding ends of the fixing belt, and a second surface in contact with an inner surface of the corresponding end of the fixing belt, and a roughness of the second surface is greater than that of the first surface.

11. The fixing device of claim 10, wherein the first surface comprises a groove extending in parallel with a rotation axis direction of the fixing belt.

12. An image forming apparatus, comprising:

an image forming device to form an image on a printing medium; and a fixing device to fix the image formed onto the printing medium, wherein the fixing device comprises:

a fixing belt disposed to be rotatable around a rotation axis of the fixing belt;

a pair of rotation ring members to support corresponding ends of the fixing belt respectively and be rotated by the fixing belt;

a pair of flange members to rotatably support the pair of rotation ring members respectively; and a pressing roller to press the printing medium by forming a fixing nip with the fixing belt, wherein a corresponding flange member of the pair of flange members includes a protrusion, formed on a first contact portion, among contact portions, on a front side of the corresponding flange member, to come into contact with a rotation ring member of the pair of rotation ring members to support the rotation ring member in an inclined state towards the fixing belt in which, with respect to the rotational axis of the fixing belt, an area of the rotation ring member opposite to a fixing nip area of the rotation ring member at the fixing nip comes into contact with the protrusion to cause the rotation ring member to protrude more towards the fixing belt at the area opposite to the pressed portion of the fixing belt than the fixing nip area.

13. The image forming apparatus of claim 12, wherein the protrusion is formed around the area opposite to the fixing nip area.

* * * * *